United States Patent [19]

Miljevic

[11] Patent Number: 4,906,890

[45] Date of Patent: Mar. 6, 1990

[54] HOLLOW ANODE OPTICAL RADIATION SOURCE

[76] Inventor: Vujo I. Miljević, Husinskih rudara 45, 11060 Belgrade, Yugoslavia

[21] Appl. No.: 105,713

[22] Filed: Oct. 6, 1987

[30] Foreign Application Priority Data

Oct. 9, 1986 [YU] Yugoslavia ..... 1735/86

[51] Int. Cl.[4] ..... H01J 1/02; H01J 17/10; H01J 19/32

[52] U.S. Cl. ..... 313/156; 313/619; 313/632

[58] Field of Search ..... 313/156, 619, 631, 632, 313/231.61, 231.71; 315/111.31, 111.41

[56] References Cited

U.S. PATENT DOCUMENTS 4,128,336 12/1978 Butler ..... 313/619 X

FOREIGN PATENT DOCUMENTS 129278 5/1977 Japan ..... 313/619 X

*Primary Examiner*—Kenneth Wieder

*Attorney, Agent, or Firm*—Ladas & Parry

[57] ABSTRACT

In a discharge tube for use in a housing for a vacuum, an improved optical radiation source is formed by a cathode and a hollow anode. The hollow anode has at least one first surface defining a hollow, partly closed space. The first surface is disposed for cooperation with the cathode. The hollow anode also has at least one second surface that also could cooperate with the cathode. Only the first of the first and second surfaces is conductive. Electrodes are respectively connected to the cathode and hollow anode.

24 Claims, 2 Drawing Sheets

HOLLOW ANODE OPTICAL RADIATION SOURCE

This invention relates to a hollow anode optical radiation source in which only the spectral lines of the operating gas, without anode or cathode material lines, are obtained.

It is well known that in order to obtain optical spectra of gases from sources based on hollow cathode discharges, arc discharge and capillary discharge are used. The disadvantages of these sources are: the presence of the cathode material lines in the spectrums from the hollow cathode discharge sources which can overlap with basic gas lines, low intensity of ion lines, high power consumptions and shorter lifetimes.

SUMMARY OF THE INVENTION

The essence of this invention is that, in order to obtain atomic and/or ion spectra of the operating gas, a new type of discharge, i.e. electric gas discharge in a hollow anode, is used. This discharge represents an intensive optical radiation source over a wide spectral range: from UV, through visible, to IR.

Thus, according to the invention, there is provided an optical radiation source having a cathode and a hollow anode, i.e. an anode having at least one first surface defining a hollow, i.e. partly closed, space for disposal for cooperation with the cathode and at least one other, second surface that could cooperate with the cathode when the first surface is disposed for cooperation with the cathode. Of the first and second sufaces, only the first is conductive.

The radiation source according to the invention provides an intensive, inhomogeneous discharge with maximal electron density and temperature concentrated in the hollow anode aperture. These effects can be further enhanced by applying a magetic field to the hollow anode aperture.

Hollow anode discharge in a magntic field is generally used for plasma generation that can be used as a radiation source.

High efficiency, long lifetime, simple construction and low production price are the main features of this novel hollow anode radiation source.

BRIEF DESCRIPTION OF THE DRAWING

Embodiments of the invention are shown in the drawing, wherein.

DESCRIPTION OF THE PREFERRED EMBODIMENTS

Figure 1:
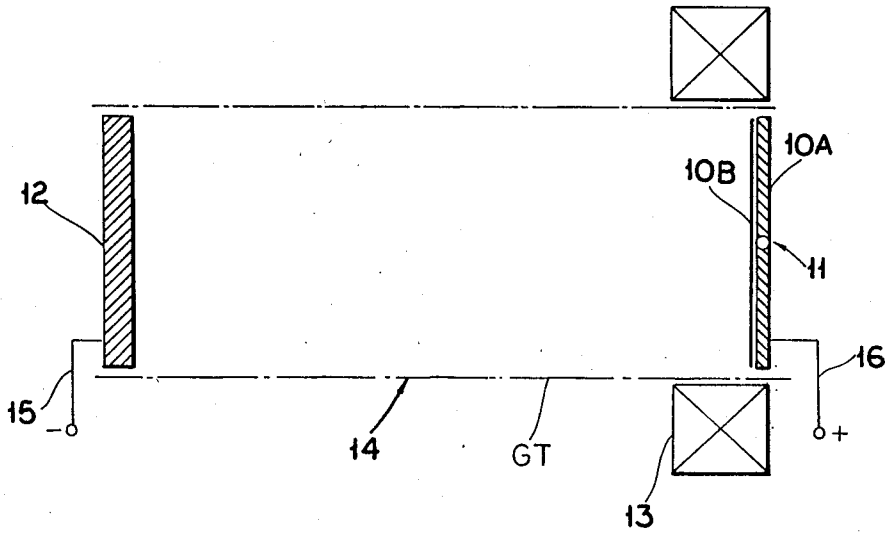
FIG. 1 is a partly schematic cross sectional elevation of a first embodiment, together with a glass tube to form a discharge tube and an electromagnet therefor.

Electric-induced optical-radiation discharge of a gas in a hollow anode aperture 11 is realized in a discharge tube at 14 as schematically shown in FIG. 1. The discharge tube has the hollow anode 10 in diode arrangement with a cathode 12 placed, for example, in a glass tube GT. The tube dimensions are not critical; they depend on application (in this case the tube is 10 cm long with 4 cm inner diameter). The cathode 12 and hollow anode 10 have respective electrodes 15, 16 for use. The glass tube with electrodes, anode and cathode is usually called the discharge tube, which is used with an electro or permanent magnet shown in FIG. 1 as electromagnet 13 about the anode 10.

The hollow anode 10 shown in FIG. 1 is a disc 10*a* (for example made of aluminum) with an aperture at 11 through the center. The disc 10*a* is insulated on the upper side or surface that could cooperate with the cathode 12, i.e. the surface facing the cathode, thus making the inner surface of the aperture itself the only conductive surface disposed for cooperation with the cathode. In princple, however, any electrode with only inner, i.e. partly closed conductive surfaces can represent the hollow anode, which can be, therefore, circular, rectangular or of other shape.

In the embodiment of FIG. 1, the upper side of the disc (facing the cathode) is insulated by a thin ceramic layer 10*b* deposited by plasma arc and, therefore, schematically represented by a dashed line in FIG. 1. In the enlarged detail of the anode 10 about its aperture at 11 of FIG. 2, the insulated ceramic layer 10*b* is shown in more detail.

The cathode 12 of FIG. 1 is another aluminum disc placed on the opposite side of the glass tube GT from the anode. Cathodes of different shapes can be used (circular, rod and other), but the most suitable are: a flat cathode as shown in FIG. 1 and concave cathodes with radii of curvature equal to the anode-cathode distances (see FIGS. 3 to 5). In the case of flat or concave cathodes of different diameters and shapes arranged as represented in FIG. 1, their diameters should be smaller than the anode-cathode spacing.

Figure 3:
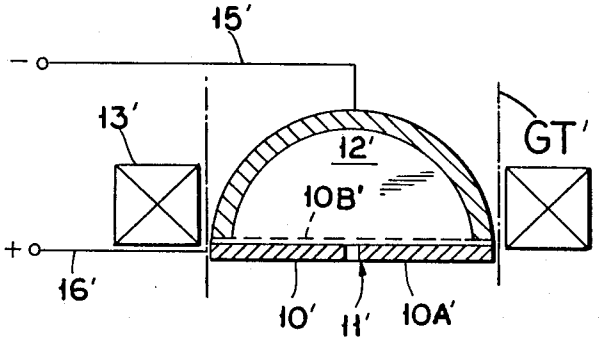
FIG. 3 is a cross sectional elevation of a second embodiment, together with a glass tube and electromagnet therefor.

In the case of a concave cathode, the cathode 12' can be hemispherical with a hollow anode 10' diametrically across its center, with a hollow anode aperture 11' at the center of the cathode curvature, as shown in FIG. 3. The components of FIG. 3 are the same as before and, therefore, identified correspondingly, but with primes. In this case, the concave cathode 12' focuses electrons into the hollow-anode aperture 11' and increases the efficiency of the gas excitation and ionization.

Figure 2:
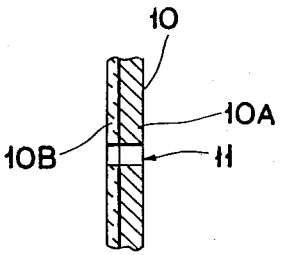
FIG. 2 is an enlarged cross sectional elevation of a portion of an anode portion of the embodiment of FIG. 1.
Figure 4:
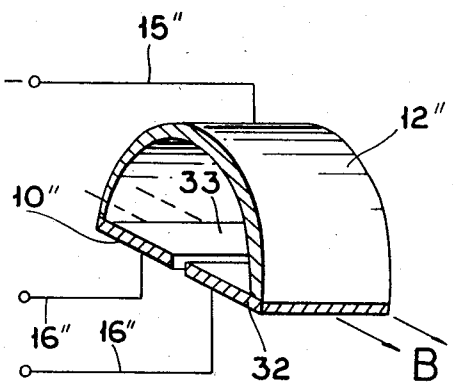
FIG. 4 is a perspective view, partly cut away, of a third embodiment, together with, schematically, an anode-parallel magnetic field for use.
Figure 5:
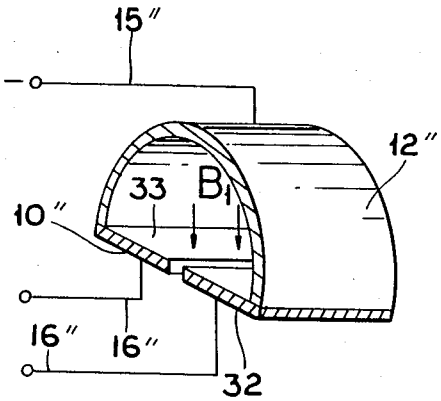
FIG. 5 is a perspective view, partly cut away, like that of FIG. 4, of the embodiment of FIG. 4, together with, schematically, an anode-perpendicular magnetic field for use.

Instead of the circular apertures of FIGS. 1 to 3, the hollow anode can have a rectangular aperture. In that case, a concave cathode 12'' can be semicylindrical, as shown in FIG. 4. In this case, the hollow anode 10'' consists of two parts 32 and 33 and the hollow anode aperture is formed between opposite conductive surfaces of these parts, which are made of magnetic or non magnetic material. In the first, magnetic-material case, the magnetic field B can be obtained (from a magnet, not shown) only across the aperture, i.e. partly closed, hollow surfaces between anode parts 32 and 33, as shown in FIG. 4. In the second, non-magnetic-material case, lines of the magnetic field $B_1$ have a component normal to hollow anode aperture, i.e. parallel its surfaces, as shown in FIG. 5. The parts 32, 33 of the hollow anode 10" can receive the same or different potentials from their respective electrode 16". The other components (some not shown) of the embodiments of FIGS. 4 and 5 correspond to those in the previous two cases.

The discharge tubes of FIGS. 1 to 5 are for high vacuum technology, representing closed housings (not shown), as known for hollow cathode discharge tubes, for example. The housings are filled by a gas in static or dynamic vacuum conditions at a determined pressure, usually on the order of 0.1–1 mbar. When in such condition a gas discharge is established with the hollow-anode diodes of FIGS. 1 to 5, a very bright plasma in the hollow anode is obtained. For the above quoted operating pressures and a discharge current of about 10 mA, the operating voltage is 400–500 V and the magnetic field, e.g. B in FIG. 4, 0–0.05 T for the very bright plasma described above.

The small surface of the hollow anode aperture and the resulting high density of the discharge current provide the high brightness of the hollow anode radiation source. By changing the discharge current, the composition of the spectrum is changed drastically. Low power consumption and the absence of secondary effects enable a long lifetime of the radiation source.

Hollow anode radiation sources of the types described above have been realized and tested in the Boris Kidric Institute for Nuclear Sciences in Vinca, Yugosalvia, and they showed the above-mentioned results.

I claim:

1. A hollow anode optical radiation source, comprising:

a cathode;

a hollow anode comprising at least one first surface defining a hollow, partly closed space, the first surface being disposed for cooperation with the cathode, and at least one second surface that also would cooperate, if conductive, with the cathode, only the first of the first and second surfaces being conductive; and electrodes respectively connected to the cathode and hollow anode.

2. The radiation source of claim 1, wherein the hollow anode comprises an anode disc, the second surface thereof faces the cathode, and the first surface thereof comprises an aperture through the anode disc.

3. The radiation source of claim 2, wherein the anode disc is conductive and the second source thereof is insulated.

4. The radiation source of claim 2, wherein the cathode is another disc parallel to the hollow anode and having a diameter, the cathode being spaced from the hollow anode and the diameter thereof being smaller than the anode-cathode spacing.

5. The radiation source of claim 3, wherein the cathode is another disc parallel to the hollow anode and having a diameter, the cathode being spaced from the hollow anode and the diameter thereof being smaller than the anode-cathode spacing.

6. The radiation source of claim 2, wherein the cathode is hemispherically curved with the anode disc diametrically across the cathode and its aperture at the center of the hemispheric cathode curvature.

7. The radiation source of claim 2, wherein the cathode is hemispherically curved with the anode disc diametrically across the cathode and its aperture at the center of the hemispheric cathode curvature.

8. The radiation source of claim 1, wherein the cathode is semicylindrically curved, and the hollow anode comprises two parts thereacross and spaced to form a rectangular-aperture first surface therebetween at the center of the semicylindrical cathode curvature.

9. The radiation source of claim 1, wherein both of the anode parts are one of magnetic and non-magnetic.

10. The radiation source of claim 1, and further comprising a magnet abaout the hollow anode for providing a magnetic field in the aperture.

11. The radiation source of claim 2, and further comprising a magnet about the hollow anode for providing a magnetic field in the aperture.

12. The radiation source of claim 3, and further comprising a magnet about the hollow anode for providing a magnetic field in the aperture.

13. The radiation source of claim 4, and further comprising a magnet about the hollow anode for providing a magnetic field in the aperture.

14. The radiation source of claim 5, and further comprising a magnet about the hollow anode for providing a magnetic field in the aperture.

15. The radiation source of claim 6, and further comprising a magnet about the hollow anode for providing a magnetic field in the aperture.

16. The radiation source of claim 7, and further comprising a magnet about the hollow anode for providing a magnetic field in the aperture.

17. The radiation source of claim 8, and further comprising a magnet about the hollow anode for providing a magnetic field in aperture.

18. The radiation source of claim 9, and further comprising a magnet about the hollow anode for providing a magnetic field in the aperture.

19. The radiation source of claim 10, and further comprising a magnet about the hollow anode for providing a magnetic field in the aperture.

20. A hollow anode optical radiation source comprising:

a cathode;

a hollow anode in which only an inner surface of an aperture therein is conductive;

means for providing a magnetic field in the hollow anode aperture; and electrodes respectively connected to the cathode and hollow anode.

21. The radiation source of claim 20, wherein the hollow anode electrode further comprises an insulated surface facing the cathode.

22. The radiation source of claim 20, wherein the cathode is semicylindrically curved, and the hollow anode comprises two parts thereacross and spaced to form the aperture as a rectangle therebetween at the center of thesemicylindrical cathode curvature.

23. The radiation source of claim 22, wherein the anode parts are of magnetic material and the magnetic field is provided only across the hollow anode aperture.

24. The radiation source of claim 22, wherein the anode parts are at one of the same and different electrical potentials.

* * * * *